United States Patent [19]

Zediker

[11] Patent Number: 4,759,309

[45] Date of Patent: Jul. 26, 1988

[54] PASSIVE PERSONAL ALARM DEVICE

[76] Inventor: Victor C. Zediker, 3226 Apache Rd., Pittsburgh, Pa. 15241

[21] Appl. No.: 86,304

[22] Filed: Aug. 17, 1987

[51] Int. Cl.[4] ..... B65D 83/00; B67D 5/32; G08B 13/00

[52] U.S. Cl. ..... 116/67 R; 116/77; 116/112; 222/39; 222/402.15

[58] Field of Search ..... 116/67 R, 112, DIG. 7, 116/77, 99

[56] References Cited

U.S. PATENT DOCUMENTS

| | | | |
|---|---|---|---|
| 3,146,916 | 9/1964 | Kronheim | 222/402.15 X |
| 3,690,286 | 9/1972 | Gantt | 116/112 X |
| 3,757,731 | 9/1973 | Pappas et al. | 116/112 |
| 4,044,712 | 8/1977 | Goodman et al. | 116/142 FP |
| 4,166,428 | 9/1979 | Freeman et al. | 116/112 X |
| 4,434,914 | 3/1984 | Meshberg | 222/402.13 X |

*Primary Examiner*—Daniel M. Yasich

[57] ABSTRACT

A passive air, gas aerosol or pressurized fluid activated personal self-protection screech alarm device that is armed prior to the person utilizing it entering into a potentially dangerous area or situation. The primary and radically different feature of this device from those currently patented and/or on the market is that no action is demanded of the person carrying it in the event of an attack other than the natural inclination to release ones grip. Releasing ones grip on the aerosol can and lever and dropping the device then activates an irrevocable screech alarm. This device plays to the psychological implications of attack in that if active, overt action is taken by the person who is the subject of a rape, for example, the attacker oftentimes becomes more violent. With this device, the natural inclination to show fright and drop whatever one is carrying serves to activate the alarm. More particularly, when the device is released from the hand, a spring loaded lever (similar in feature to a military hand grenade) flies up and away from the can and becomes separated. That in turn releases a spring loaded fly-away plug valve allowing the propellant to escape and sound the alarm signaling portion of the device.

1 Claim, 2 Drawing Sheets

PASSIVE PERSONAL ALARM DEVICE

BACKGROUND OF THE INVENTION

It is the contention of the inventor that until now there has existed no practical, effective form of self-protection available to females, elderly males and females and children. A rape occurs in the United States every six minutes. Attacks on the elderly and children have reached disturbing and alarming levels. Any weapon, fluid irritants etc, is generally rendered useless in a short time by the attacker, often is used against the victim and serves to further incite the demented attacker to do more harm to the victim. Current warning or alarm devices all require some form of active, overt motion on the part of a victim (pushing a button continously, pulling a removeable pin) after the attacher makes his intention known. These devices can be rendered useless by mere threat or by the attacker simply knocking them from the victim's hand. Furthermore, if the victim is able to momentarily sound them, that action also often results in inciting the attacker to do further harm.

It is the contention of the inventor that what is needed to combat acts of rape or other violence is a device that is passive in nature—one that requires no positive, overt action on the part of the victim and one that is irrevocable once it is utilized. The attacker has no recourse when this device is utilized but to rapidly flee the scene.

FIELD OF THE INVENTION

This invention relates generally to a hand carried, passive, compressed air, aerosol or pressurized fluid powered personal alarm. In its particular aspects this invention relates to a pressurized air, aerosol or fluid powered alarm that is passive in nature once armed and is irrevocably sounded by the victim merely releasing her grip on a top mounted and side held, spring loaded valve retaining lever.

It should be understood that the description and drawings herein are illustrative only and that various changes and modifications can be made in the structure of the device without departing from the spirit of the invention. The key and most important feature claimed is the passive aspect of this self-protection device.

DESCRIPTION OF THE PRIOR ART

Various aerosol powered devices do currently exist that are capable of summoning aid by means of an air powered horn. However they all require active, overt action on the part of the person carrying them after the attacker makes his intentions known.

U.S. Pat. No. 4,044,712, Aug. 30, 1977 to Goodman and Jaremus requires active, overt action to trigger the Pressurized Fluid Powered Horn after the attacker makes his intentions known. Nor has the device provided for any deterent value through broadcast, by bright warning orange coloring, that it is being utilized.

OBJECTS OF THE INVENTION

It is an object of this invention to provide a hand carried, passive, pressurized air, aerosol or fluid powered personal alarm that is armed prior to the person utilizing it entering into a potentially dangerous situation or area.

It is a further object of this invention to provide a potential attack victim a highly audible alarm powered by one of the above means inciting a horn, whistle, siren or other noise producing device that is then activated by the person utilizing it merely releasing their grip on the aerosol can and top mounted, side held, spring loaded valve retaining lever.

It is a further object of this invention to provide for a reuseable feature whereby the device can be deactivated if not used within the potentially dangerous area or situation by reversing the method of activation.

It is a further object of this invention to discourage attacks before they are instituted through the highly visible safety and warning related colors decorating this device.

SUMMARY OF THE INVENTION

Briefly, the aforementioned and other objects of this invention are satisfied by providing a hand carried, compressed air, gas, aerosol or pressurized fluid powered personal alarm device which includes a container (aerosol can) decorated with various safety and warning colors, a spring loaded fly-away plug type valve, various sounding devices to include but not limited to shrill whistles, vibration induced and other horns, a small siren or other noise producing devices, a perforated protective cap to prevent muzzling of the warning sound, a spring loaded, fly-away, top mounted and side held valve retaining lever, one of various retaining lever restraining devices to include but not limited to a top mounted chain held pull pin, side mounted twist control band and side mounted push/slide button.

The device is armed by the person carrying it removing the chain held pull pin, turning the side mounted twist control band or pressing and/or sliding the side mounted release button or various other methods when the person enters into a dangerous situation or area. The alarm is kept from sounding until needed by the person carrying it retaining their grip on the aerosol can and side mounted, spring loaded, fly-away valve retaining lever. Should the person utilizing the device have need to activate it they have merely to release their grip and allow the device to fall to the ground.

At that point the side mounted, spring loaded valve retaining lever flies up and away and is separated from the aerosol container and allows the spring loaded, fly-away plug type valve to release and become separated from the device. The release and separation of the valve permits the pressurized air, gas, aerosol or fluid to activate the shrill whistle, vibration induced horn, siren or other sound producing device to produce and emit a loud, attention getting noise to be heard at a great distance and to alarm, confuse and disorient the potential attacker and frighten him away, thereby allowing the potential victim to escape the situation.

Should it not be necessary for the person carrying it to have activated the device during the potentially dangerous period, they have then but to simply disarm the device for later use by reinserting the retainer pin, reverse twisting the side held twist control band or pushing the control button in the opposite direction.

An additional feature on certain models is that they can be periodically tested by partially releasing the valve control lever.

DETAILED DESCRIPTION

Figure 1:
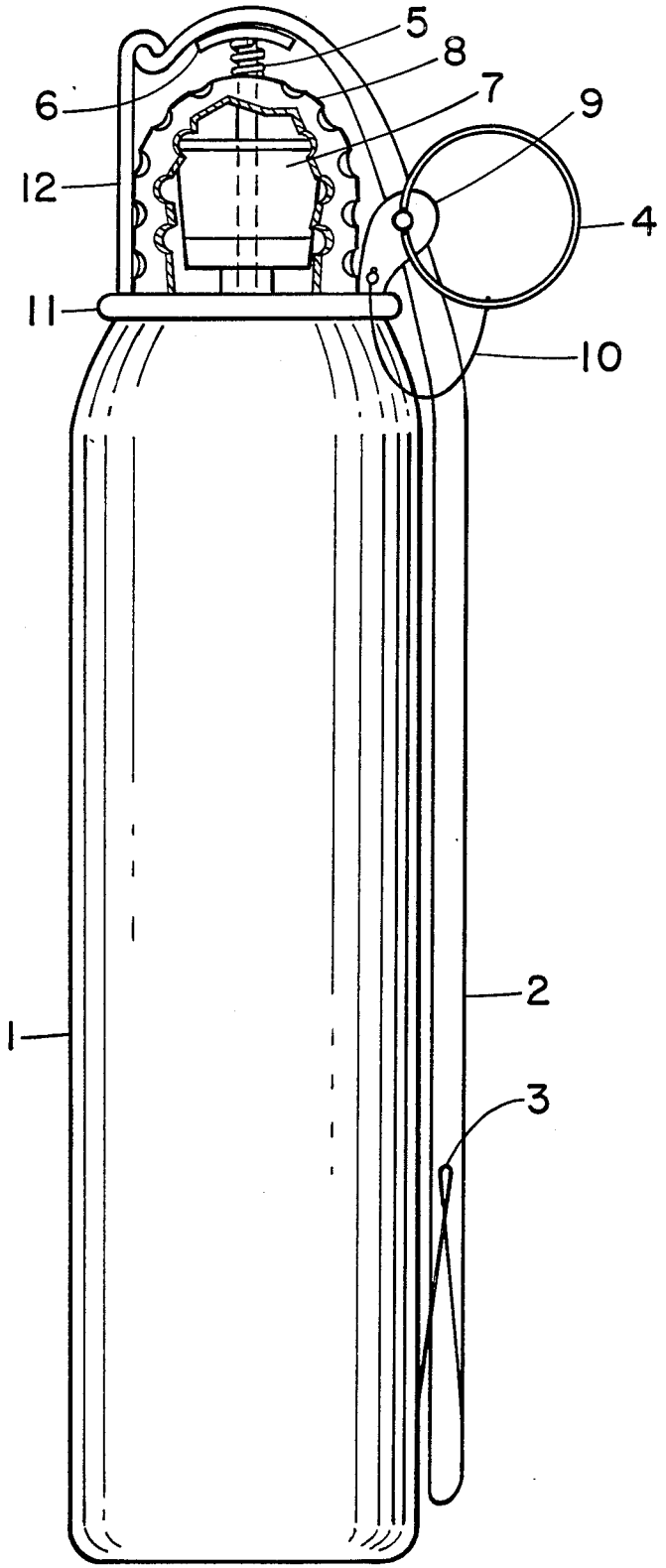
FIG. 1 is a view in perspective of the passive personal alarm device.
Figure 2:
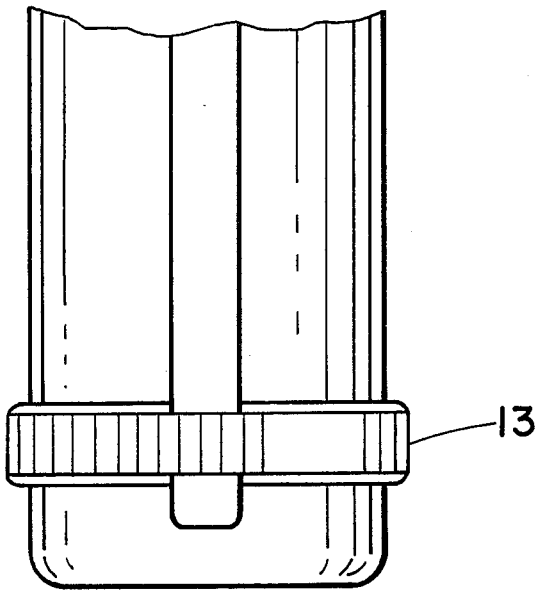
FIG. 2 is a view of an alternate method of keeping the side held valve retaining lever in the inactive state.

The device is generally indicated in the accompanying drawings. The device comprises a standard aerosol can 1 to include a two-piece draw-redraw steel or aluminum vessel or a three-piece welded or soldered steel vessel. The aerosol container 1 is capped by an assembly that includes a seamed on cap 11 upon which is mounted a valve retaining lever holder 12, a perforated metal protective cap 8, a vibration induced horn 7 (or shrill whistle, small siren or other noise producing device), a pull-pin holder 9, a fly-away plug type valve 6, a fly-away valve spring 5, a top mounted and side held valve retaining lever 2 upon which is mounted a lever spring 3, the lever being kept from release by a chain 10 held pull pin 4 (or turning the side mounted twist control band 13 or pressing and/or sliding the side mounted release button or various other methods).

Upon entering a potentially dangerous situation or area the person utilizing the device grasps the aerosol container 1 in one hand to insure that a portion of the hand or fingers also encircle the valve retaining lever 2. With the other hand the person utilizing the device removes the ring and pull-pin 4 allowing it to dangle on chain 10 (or turns the side mounted twist control band 13 or presses and/or slides the side mounted release button or uses various other methods) thus arming the device. Should the person utilizing the device suffer an attack they have but to release their grip and drop the device. At that point the valve retainer lever spring 3 drives the valve retainer lever 2 away and up from the aerosol can 1. The plug type valve spring 5 then continues to drive up the valve retaining lever and also drive up the plug type valve, the valve retaining lever pivoting on the valve retaining lever holder 12. When the valve retaining lever 2 has traveled approximately 180 degrees it separates completely from the device. At that point the plug type valve spring has driven the plug type valve up and out of the aerosol can plug 11, horn 7 and perforated metal protective cap 8, the spring 5 and plug 6 becoming completely separated from the device and allowing the aerosol propellant contained in the aerosol can 1 to activate the horn 7 thereby producing an alarming sound to be heard at a great distance.

Should the person utilizing the device have no need to activate it after arming, they have merely to reinsert the pull pin and ring 4 (or turn the side mounted twist control band in the opposite direction or press and/or slide the side mounted release button in the opposite direction or reverse one of the various other methods of arming the device) thus having the device available for its next use.

What is claimed is:

1. A passive (after arming) compressed air, gas, aerosol or pressurized fluid hand carried, personal, self-protection screech alarm device that is armed prior to the time a person utilizing it enters a potentially dangerous area or situation by removing the top mounted, chain held pull pin, or one of the methods described below, and maintaining ones grip on the container and top mounted, side held, spring loaded valve retaining lever, the device comprising: a container of pressurized air, gas fluid or other aerosol substance, said container being a commercially available steel or aluminum vessel, commonly referred to as an aerosol can, and decorated with various safety related colorings; said container being capped by a spring loaded, fly-away plug type valve; said valve being mounted through a sounding device to include a shrill whistle, vibration induced horn, small siren or other noise producing device; said noise producing device being contained in a perforated metal protective cap to prevent muzzling of the sound or breaking off of the sound producing device; said spring loaded, fly-away plug type valve being kept in place until use by a spring loaded, fly-away, top mounted and side held valve retaining lever; said spring loaded, fly-away top mounted and side held valve retaining lever being kept in place until arming by a top mounted, chain held pull pin, top mounted and side held twist control band, side mounted push and/or slide button or various other lever restraining devices; said arming being accomplished by the removal of the top mounted, chain held pull pin, turning the side held twist control band, pushing or sliding the side mounted push and/or slide button or various other lever restraining devices; said lever restraining devices being used to activate said passive personal alarm device prior to the time a person carrying it enters into a potentially dangerous situation or area; said lever restraining devices being capable of being disarmed by reversing said methods of arming should the device not have to be utilized during said potentially dangerous encounter; said device being activated after arming by the person carrying it simply releasing their grip and dropping it to the ground whereby said top mounted, side held valve retaining lever flies up and away from container and is released from the device; whereby spring loaded, fly-away, plug type valve is released and separates from the device allowing the pressurized air, gas, fluid or other aerosol substance to excite the shrill whistle, vibration induced horn, small siren or other noise producing device resulting in a shrill noise meant to be heard at a great distance and to alarm, confuse, disorient and frighten away the potential attacker.

* * * * *